US006918137B2

(12) United States Patent
Fowler

(10) Patent No.: US 6,918,137 B2
(45) **Date of Patent: *Jul. 19, 2005**

(54) PROTECTIVE HAND GUARD

(76) Inventor: Sandra S. Fowler, 19201 Brookgreen Garden Pl., Cornelius, NC (US) 28031

( * ) Notice: Subject to any disclaimer, the term of this patent is extended or adjusted under 35 U.S.C. 154(b) by 0 days.

This patent is subject to a terminal disclaimer.

(21) Appl. No.: 10/770,081

(22) Filed: Feb. 2, 2004

(65) Prior Publication Data

US 2004/0148682 A1 Aug. 5, 2004

Related U.S. Application Data

(62) Division of application No. 10/163,537, filed on Jun. 6, 2002, now Pat. No. 6,684,406.
(60) Provisional application No. 60/296,514, filed on Jun. 8, 2001.

(51) Int. Cl.[7] ..... A41D 13/00
(52) U.S. Cl. ..... 2/16; 2/21
(58) Field of Search ..... 2/16, 20, 21, 159, 2/161.1, 163, 167, 455; 128/879, 880; 602/21, 22, 64; 606/55

(56) References Cited

U.S. PATENT DOCUMENTS 852,972 A * 5/1907 Mackay ..... 2/161.6
871,805 A * 11/1907 Evam ..... 30/123.5
1,358,823 A * 11/1920 Burden ..... 2/163
1,642,311 A * 9/1927 Richardson ..... 56/328.1
1,951,190 A * 3/1934 Gambee ..... 2/21
4,751,747 A * 6/1988 Banks et al. ..... 2/21
4,796,302 A * 1/1989 Davis et al. ..... 2/21
5,450,626 A * 9/1995 Sorrels ..... 2/21
5,749,097 A * 5/1998 Garrett-Roe ..... 2/21
6,565,563 B1 * 5/2003 Agee et al. ..... 606/55

* cited by examiner

*Primary Examiner*—Tejash Patel
(74) *Attorney, Agent, or Firm*—Malcolm E. Whittaker; Whittaker Law Firm

(57) ABSTRACT

A hand guard is disclosed having impermeable protection features and allowing skin contact on the pads of the fingers and thumb on a sensing hand. The first foil is a metacarpal guard shaped to cover the metacarpals and wrap around to cover a portion of the palm and thenar web space and having a fastener to fasten the first foil to itself. The digit guards include a thumb guard. Each digit guard is shaped like an elongated, hemispherical, cupped foil with contours to fit in overlying position for covering the dorsal and lateral portions of the thumb extending over a portion of both phalanges of the thumb. The digit guards are linked to the metacarpal guard, and each contain fasteners to retain the digits against the digit guards.

5 Claims, 8 Drawing Sheets

29
28
29

29
28
29

29
28
29
2b
29
28
29

29
28
29

PROTECTIVE HAND GUARD

RELATED APPLICATION(S)

Applicant claims the benefit of a provisional patent application filed on Jun. 8, 2001, with Ser. No. 60/296,514, applicant also claims the benefit of U.S. application Ser. No. 10/163,537, filed Jun. 6, 2002 now U.S. Pat. No. 6,684,406, this application is a divisional application of U.S. patent application Ser. No. 10/163,537.

Attorneys for Inventor: Malcolm E. Whittaker, Registered Patent Attorney No. 37,965, Whittaker Law Firm, 8 Greenway Plaza, Suite 606, Houston, Tex. 77046-0801

TECHNICAL FIELD OF THE INVENTION

The present invention relates to an attachable hand guard device. The device covers regions of the hand and certain digits which are useful for protecting health service providers, e.g., nurses, respiratory therapists and other health care workers from injury or infection caused by accidental self-inflicted hand punctures or cuts from sharp implements ("sharps") like hypodermic needles, lances, scalpels and the like. More particularly, an assembly comprising a metacarpal guard wrap is flexibly linked to two or more digit guards that are retained to the digits when the guard is donned, and cover susceptible areas on the back and sides of the wearer's thumb, index finger, middle finger and thenar web space to reduce the risk of injury or infection from accidental wounding by sharps sticks. It is expected that a significant percentage of health service providers that will use the invented Protective Hand Guard will be respiratory therapists. However, it is believed that the invented Protective Hand Guard will be useful to any health service provider seeking to avoid and minimize the danger of injury or infection caused by accidental self-inflicted hand punctures or cuts from sharp implements ("sharps") like hypodermic needles, lances, scalpels and the like.

BACKGROUND OF THE INVENTION

Injuries from sharp implements such as syringe needles are particularly dangerous to health and medical personnel who run the risk of exposure to disease. Avoidance of contracting communicable diseases such as hepatitis-B, and AIDS is a special concern to medical personnel treating patients afflicted with these diseases. Each of these diseases can be communicated to medical personnel as a result of an accidental injury when handling a contaminated needle, for instance, which has been used to take blood samples or administer intravenous liquids to a patient.

Typically, an intravenous therapy service, such as a respiratory therapist provider, must locate a suitable blood vessel in a patient's limb, normally the arm, by palpating the body part. This requires maximum tactility at the fingerprint area of the index and middle fingers of the nurse in order to locate a suitable blood vessel. Upon location of the blood vessel, the nurse inserts a hypodermic needle through the skin into the vessel to inject a fluid or withdraw the patient's blood which, in either case, contaminates the needle. Once the procedure is complete, the needle is generally re-sheathed and discarded. Portions of the sensing hand are particularly vulnerable. The metacarpal region, thenar web space, thumb and first and/or second fingers are high-risk areas of the hand which are protected by the several embodiments of the present invention.

A myriad of devices adapted to shield the sensing hand opposite the hand carrying the sharp implement have been taught. U.S. Pat. No. 5,070,543 ('543 patent") for example, discloses the application of one or more impervious shields which are selected and adhered on the surface of a donned surgical glove. The adhesively affixed shields are shaped for example, to cover the palm, the index and/or the third finger of the left (or sensing) hand. The shields can be selected by the practitioner for a particular procedure and the location of the shields would vary according to the '543 patent's invention. The shields affixed to a disposable surgical glove would be selected and affixed to the glove prior to the procedure involving a sharp. It would be desirable to provide a simpler and faster mode of donning and removing a disposable shield apparatus with or without usage of a surgical glove. It would be desirable to provide a hand guard device which resists puncture or through-cuts, but allows for normal articulation of the sensing hand, and original tactile sensitivity, and which is easily donned, and inexpensive to provide disposability upon a single use.

Accordingly, there is a need in the art for improved hand guards and methods for making a hand guards which may be used by medical personnel when handling sharps.

SUMMARY OF THE INVENTION

The present invention provides a hand guard for use by health service providers to protect a sensing hand from accidental injuries when handling sharp implements in the other hand. The sensing hand guard comprises a minimum of three guards, including a metacarpal guard that covers the metacarpal region up to the wrist and over the first knuckles and partially or completely wraps around the thenar web and palm area; and index and middle finger guard(s) which are elongated cup-shaped, hemispherical films covering a portion or all of the dorsal and lateral sides of the fingers, and extending along each digit to cover one, two or preferably all of the phalanges. Additionally, a guard may also protect the thumb. The ventral sides of the thumb and fingers are not covered by the respective guards, except for the fasteners and are exposed for preserving tactile sensation or sensitivity of the wearers skin for direct contact with the patients skin.

Therefore in accordance with a basic aspect of the invention there is provided a hand guard for protect a sensing hand which comprises three nonporous foils. The first foil is a metacarpal guard shaped to cover the metacarpals and wrap around to cover a portion of the palm and thenar web space and having a fastener to fasten the first foil to itself. The index finger guard is shaped as an elongated, hemispherical, cupped foil with contours to fit in overlying position for covering the dorsal and lateral portions of the index finger extending over a portion of the phalanges of the index finger. The second digit guard is a finger guard shaped as an elongated, hemispherical, cupped foil with contours to fit in overlying position and covering the dorsal and lateral portions of a finger over a portion of three phalanges of the finger, wherein each of said digit guards are connected to said metacarpal guard by a flexible linkage, providing partial rotation and translation of the digit guards. Each digit guard linkage is affixed at the proximal ends of each digit guard and bridging space and affixed at the distal end of the metacarpal guard. The digit guards are aligned with the projection of the thumb and index finger. The digit guards each provide a digit fastener to retain the digit guard in close proximity to the dorsal side of the finger. The digit fasteners or digit retainers will yield to the digits for insertion and removal, or have one fastening end that can be released or fastened when donning and doffing the guard. Each digit guard allows direct skin contact with substantially all of the ventral side of the digits, especially at the distal pads of the last phalange of each digit.

In a preferred embodiment there is provided in accordance with the invention a hand guard comprising a metatarsal guard in flexible linkage with at least two digit guards, comprising an index finger guard and a middle finger guard. The digit guards are elongate, approximately hemispherical, cupped shields that cover a portion of or both phalanges on the dorsal side of one, two or three of the phalanges of the first, also referred to as the "index finger," and the second, also referred to as the "middle," finger and include digit retainers or fasteners to urge and retain the digits against the underside of the cupped-shaped guards. The fasteners are located typically over the interphalange joint, such as at the joint between the first and second, or between the second and third phalanges of the fingers, and in the thumb, between the first and second phalange. Digit retainers located at the joints are preferred so as to allow the intervening digit pads to be unobstructed for maximal sensing.

In the most preferred embodiment, the metacarpal guard wraps around an area covering the metacarpals up to the wrist, and is fastened to itself at its lateral ends, wrapping around the axis of the hand. The metacarpal guard is linked to each of separate thumb, first and second finger guards by a flexible linkage, such as by bands, monofilaments, adhesion or fusion bonded (heat sealed) strips or tapes, push-tab or slot-tab containing straps, interconnecting narrow regions of an integral single piece, or a strap that is integrally molded at one end and contains a free end thus contains any fastener, such as push-tab, slot-tab, adhesive, loop pad for a hook and loop, an affixed snap for use with a snap pair, a and the like, allowing free hand articulation. The thumb and first finger guards provide the selected fastener for strapping the guard to the digits at a selected point along the length of the digits, and preferably are located over the first thumb phalange, and over the second finger phalanges. Not all fasteners may be of the same type for each digit guard.

The flexible linkage between the metacarpal guard and digit guards enables selection of a wide variety of materials for the guard components, and provides spacing or overlapping of the digit guards with the metatarsal guard for comforming to varying size of wearers hand for free articulation of the thumb and finger(s) in the normal range of grasping and finger motion used in holding and sensing the body of the patient.

In a specific aspect of one embodiment, the metacarpal guard is linked to the thumb and finger guard(s) with a strap, fastened at distal points on the metacarpal guard, and at proximal points of the thumb and finger guards.

In another embodiment, the metacarpal guard is integrally linked with the thumb and finger guards by extensions from the distal portion of the metacarpal guard, the extensions being aligned with each digit, and providing linking via a thin and/or narrowed strand portions bridging the knuckles of the thumb and fingers to the digit guards. By integral linkage, it is meant permanent linkage of the parts, molded-in, made during fabrication such as by fusion bonding, heat sealing, and the like and not intended to be removable like with snap-fit or slot-tab fasteners. Integral linking members integral at with the digit guard (as in a protrusion) or integral with the digit and metacarpal guard can readily be formed with the guard in a single injection shot.

In yet another embodiment, the metacarpal guard is linked to the thumb guard by a flexible linking member and the one or more finger guards are not linked to the metacarpal guard, but removably attached to the finger(s) by any of the straps, tapes, integral push- or slot-tabs, and the like.

When donning the apparatus by the various attachment systems the metacarpal guard is wrapped around the hand and fastened to itself, the thumb guard is affixed to the thumb and the one or more finger guards are affixed to these digits using one of the selected attachment systems. Among the several types of economical systems for attaching the hand guard at the hand, thumb and fingers there is including but not limited to the foregoing exemplary attachment systems and adhesive tape, direct skin-contacting adhesive affixed to the under or skin-contact side of the guards, attached hook and loop strips or tape, affixed tab-insert loop, integral tab-insert loop, affixed slot-insert tabs, integral slot insert tabs, riveted strap, adhesively affixed tape, heat-sealed or fused tape or strapping, snap-engaging strap, and the other attachment systems which are equally functional and obvious from the foregoing for retaining the guards to the respective anatomical features involved.

In yet another embodiment, the metacarpal guard is linked to the index finger guard but not the thumb guard, and the thumb guard is removably affixed to the thumb such as by any of the aforementioned digit fastening systems. In a specific such embodiment, different fastener systems are employed as for the metacarpal guard and digit guards. In one example, the metacarpal guard is fastened by hook and loop strip being joined on the ventral side, and the digit guards are attached to the digits by way of direct skin-adhering adhesive which is affixed to the underside surface of each digit guard. The adhesive is revealed at the time of donning the guard by way of peeling off of release layers, such as silicone release paper.

These and other embodiments will be more fully appreciated from the description below.

DESCRIPTION OF THE PREFERRED EMBODIMENTS

Reference in this description to location, feature, orientation and directional terms such as "metacarpals", "phalanges", "distal", "proximal", "dorsal", "ventral", "medial" and "lateral", and others are used in the ordinary meaning ascribed to the human hand, are ordinary anatomical terms, and no special meaning is ascribed thereto. In the digits, reference to the first phalange means the proximal, the second phalange is distal and adjacent to the first phalange, and the third phalange of a finger is adjacent and distal to the second phalange. Dorsal means the back side of the anatomical feature, and ventral means the underside or palm side of said feature. Medial means toward the body axis, and lateral means away from the body axis or axis of the appendage. Dorsal includes the sides of a digit and back side.

Figure 1:
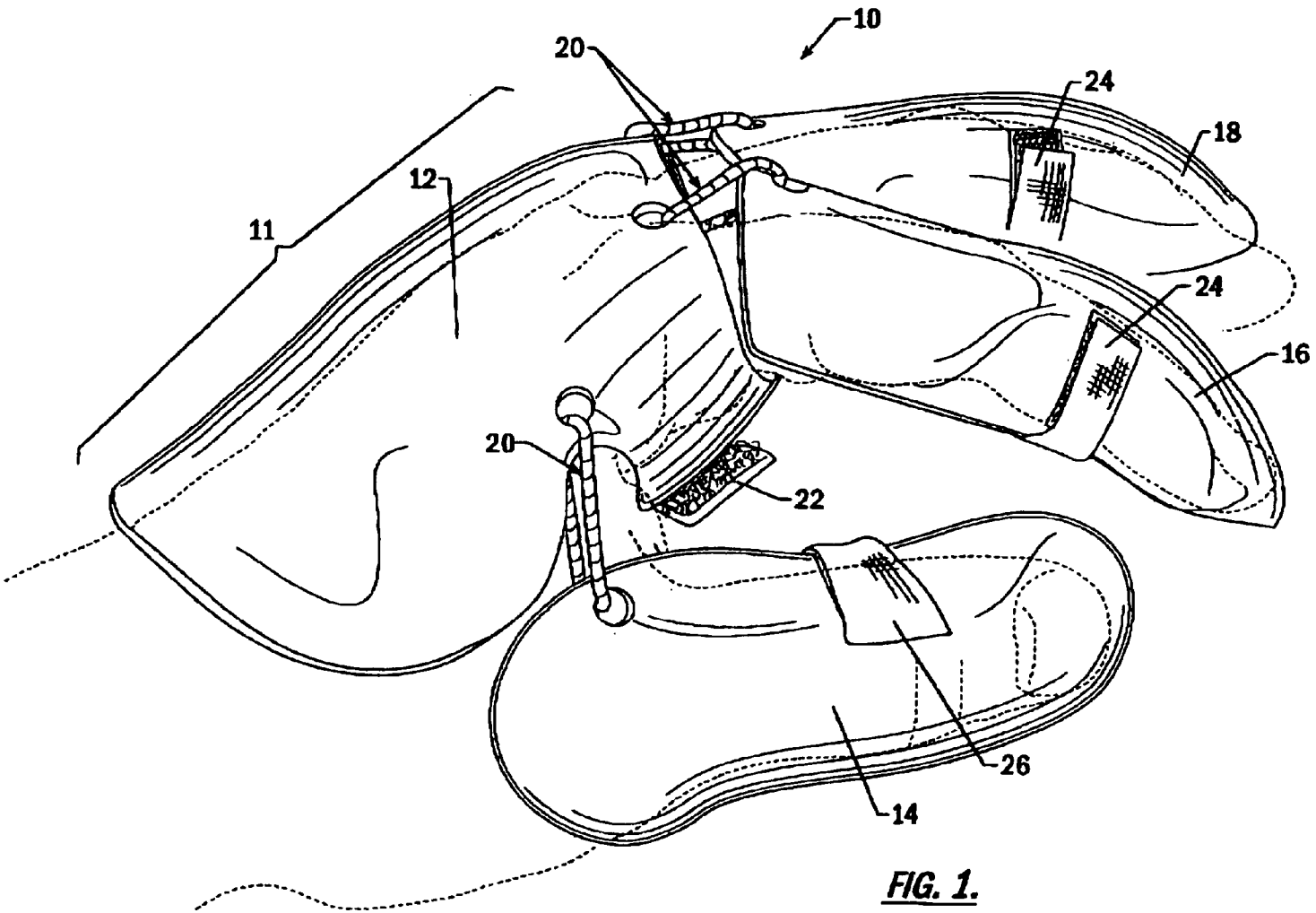
FIG. 1 is a perspective view of a hand guard containing a metacarpal guard and three digit guards connected to the metacarpal guard by bands, with all fasteners of the hook and loop type tapes.

Referring now to FIG. 1, wherein, like numerals designate like components or structures, and throughout the application where like numerals designate like components or structures, a preferred form of hand guard 10 is illustrated with metacarpal guard 12, shown as fastened by hook and loop tape at 22 on the palm side extending around the metacarpal region 11 from the wrist to just beyond the first knuckles of the hand. Thumb guard 14 is fastened to the thumb by hook and loop tape at 26. In the illustration of FIG. 1, the hook pad is affixed to one side of the guard and the loops are provided on a tape extending around the hand feature to engage the hook pads. First finger guard 16 and second finger guard 18 are fastened to the respective digits by hook and loop tape 24. Metacarpal guard 12 is linked to the digit guards by three bands at 20. Hand guard 10 features flexible linkages to allow pivoting and wide range of motion of the digits. The digit guards provide borethrough holes at the proximal ends for interconnecting with distal borethrough holes on the metacarpal guard by way of bands 20.

As shown in FIG. 1, each distal end of the elongated cup-shaped hemispherical digit guards tapered for conforming to the shape of the digits can extend to the end of the digit. Any digit guard, such as one or more digit guards can be sized to extend past the end of the respective thumb or finger by up to about 1 cm. so that the thumb and index finger ends are protected from angular needle sticks. Preferably, the first finger guard extends beyond the end of the first finger, the second finger guard terminates over the third phalange, just before the fingernail, and the thumb guard extends just over the tip of the thumb. The metacarpal guard wraps the hand and should cover nearly all of the dorsal thenar web space region and come close to the wrist.

Aside from a one-piece constructed embodiment, referred to hereinbelow, the thumb guard 14, index finger guard 16, and optional second finger guard 18 are jointed together with the metatarsal guard in aligned locations relative to the orientation of the respective digits by a flexible band or loop, an adhered strap, a tied filament, or by way of a elongated protrusion from the metacarpal guard which contains an insert or push-tab at each end which is inserted in slots or borethrough holes on each of the digit guards and the metacarpal guard. Other suitable fasteners include screw/bolt combinations, gimbals or any other nonabrasive fastener which allows pivotal, rotational and/or translational movement of the thumb and finger(s) relative to each other and the metacarpal guard.

In FIG. 1, the embodiment illustrates that the guards 14, 16 and 18 can be secured to the digit distal of the first interphalange joint of the thumb and distal to the middle interphalange joint of the index and second fingers. An effective form of attachment strap for the digits in the present invention is a hook and loop strap, often referred to by a well known trademark Velcro®. Such a hook and loop strap can be incorporated by, for example, affixing a strip of hook tape transversely across the width of the applicable guard component such as at 12, 14, 16 and 18 at about the interphalange joint of the thumb and middle phalanx of the finger(s). Such hook tape can be affixed near one lateral edge of the digit guard with glue, by heat-sealing, sonic welding, or other suitable adhesive providing adequate cohesive strength and adhesive strength. A number of adhesives suitable for fixing the hook tape or pad are commercially available, such as various contact adhesives, PSAs, 1 and 2-part urethanes, hot melts and the like. A longer strip of loop tape is attached to the other side of the guard in like manner and is wrapped around the hand, thumb or finger and attached to the affixed hook tape or pad. The use of a hook and loop strap allows adjustable fitting securely to the hand with one sized hand guard to accommodate a variety of user hand sizes.

Figures 2A, 2B, 2C:
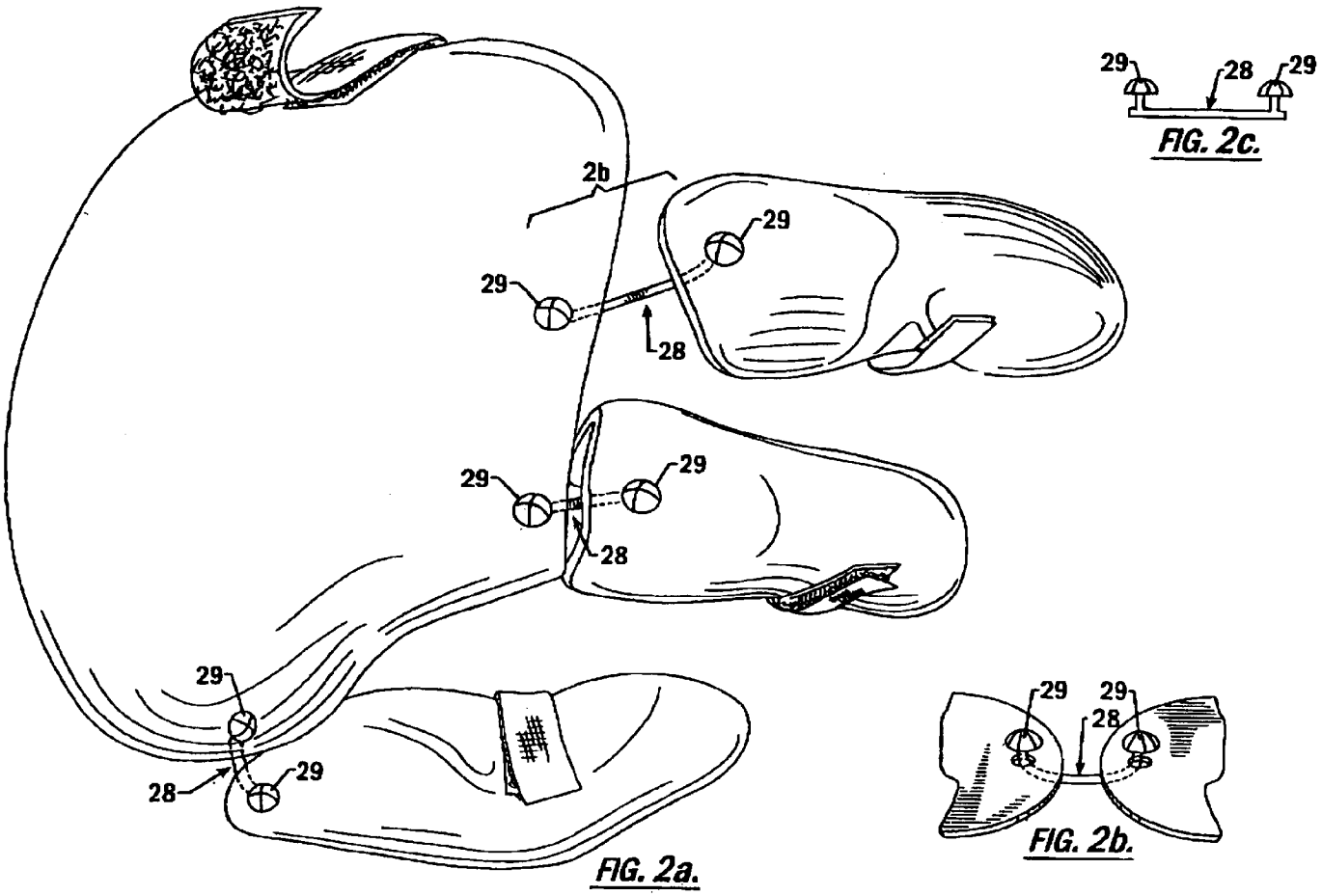
FIG. 2 is a top plan view of a hand guard containing a metacarpal guard and three digit guards connected to the metacarpal guard by push-tab containing strands, with all fasteners of hook and loop type tapes

With reference to FIG. 2, the linking members 28 comprise molded linking straps that containing terminal tapered push-tabs 29 on linking members 28, seen in magnified detail in FIG. 2B. The molded straps 28 are fabricated from a relatively soft thermoplastic, TPE, elastomer, and the like and the tapered push-tabs 29 are dimensioned with a larger diameter than the borethrough holes on the guards. Assembly is made by pressing the push tab through the borethrough holes until it yields and emerges past the surface opening. As seen in FIG. 2C, the push tab has a mushroom profile, including a flange portion that rests against the guard surface, retaining the push-tab strap and urging the opposite lateral sides of the digit guards in a fold so as to cover the sides of the digits.

Figure 3:
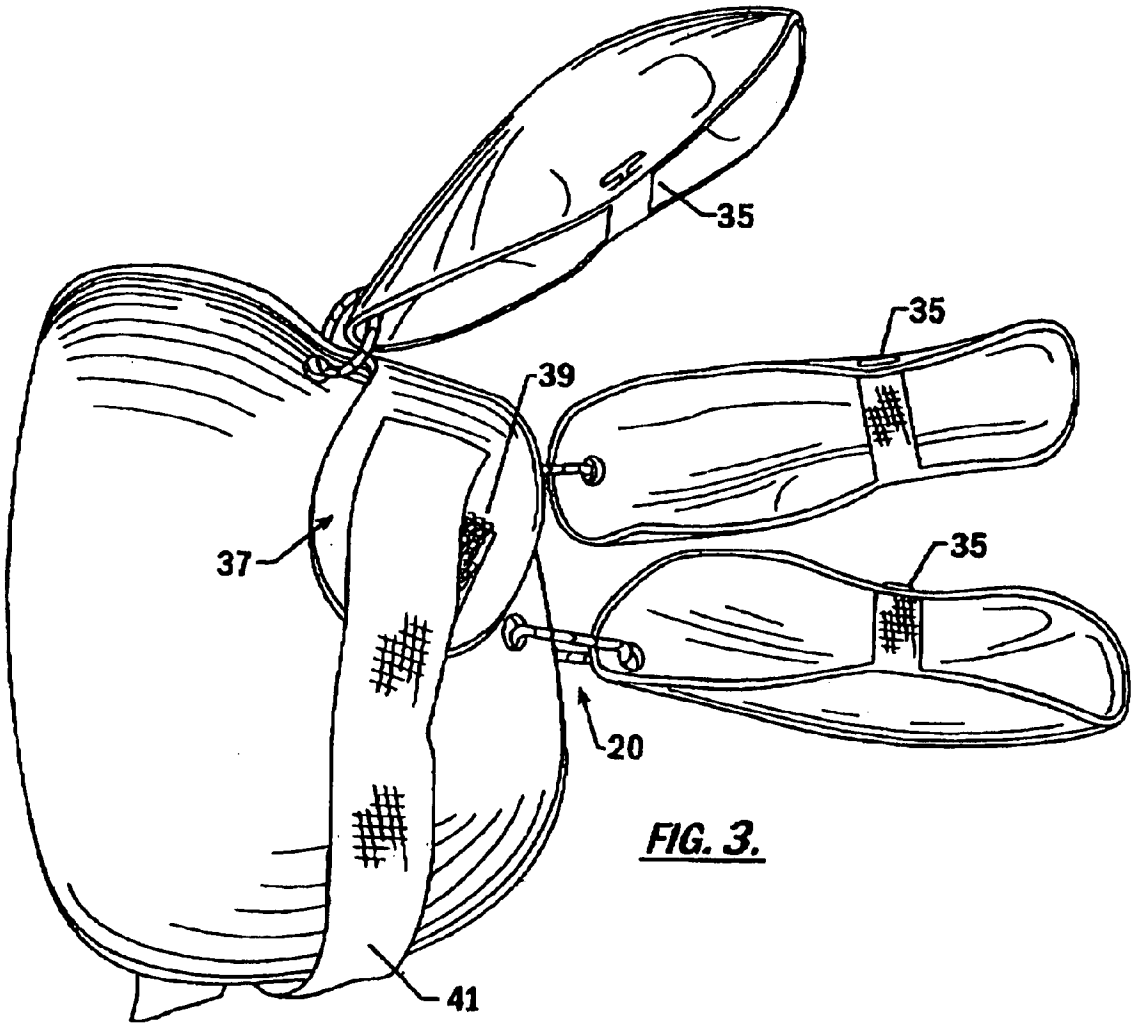
FIG. 3 is a bottom plan view of a hand guard containing a metacarpal guard and three digit guards connected to the metacarpal guard by bands, with the metacarpal guard containing a fastener of the hook and loop type tapes, and the digit fasteners of integral slot-tab protrusions.

With reference to FIG. 3, digit guards are linked with loop bands 20. Integral slot-tab inserts extend from the sides of each digit guard and insert into slots on the opposite side of the guard spanning the ventral facing guard opening for receiving and retaining the digits in close covering relationship but revealing a substantial area of the ventral side of the digits. The slot insert tabs are inserted by forcing through the slot, or slit cut-through on the edge of the digit guards. The width dimension of the terminal insert tab is larger than the slot or slit cut-through width, and upon forcing or folding the ears of the insert tab, the tab portion is pushed through the slot, and the integral strap it is affixedly retained to hold digit guard against the dorsal side of each of the digits (thumb and finger(s)).

Figure 4:
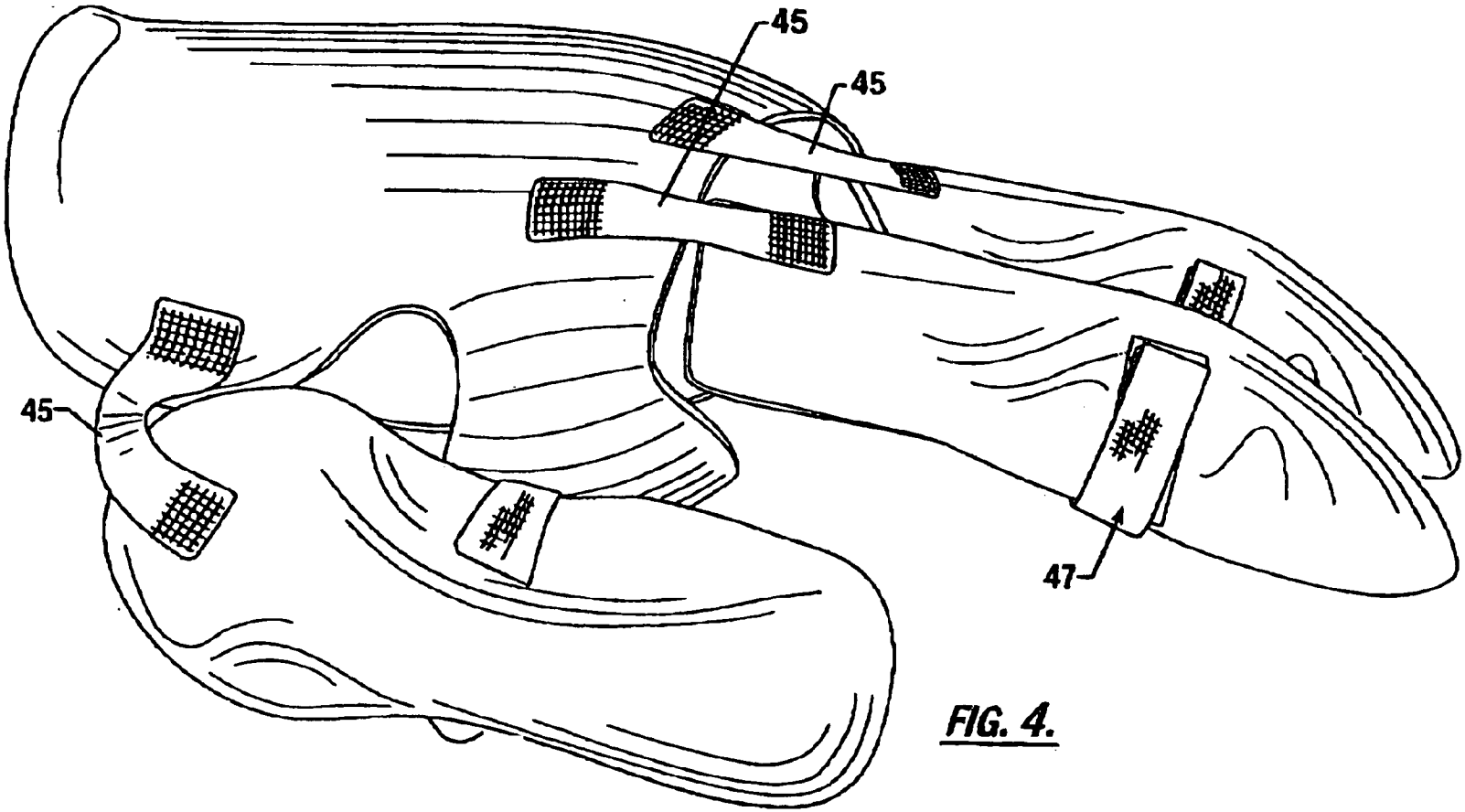
FIG. 4 is a side plan view of a hand guard containing a metacarpal guard and three digit guards connected to the metacarpal guard by bonded bands, with the metacarpal guard containing a fastener of the hook and loop type tapes, and the digit fasteners containing fasteners of the hook and loop type tapes.

With reference to FIG. 4, showing a side perspective view, the digit guards are linked to the metacarpal guard by adhesive strips or tapes, and the digit retention system is a hook and loop attachment as at 47. FIG. 4 illustrates wrapping of the metacarpal guard onto itself by way of hook and loop fasteners. In this illustration the hook pad is affixed to the protruding medial portion of the guard, and loop tape is affixed to the opposite side and extends on the palm side of the hand to fasten this guard to the hand.

Figure 5:
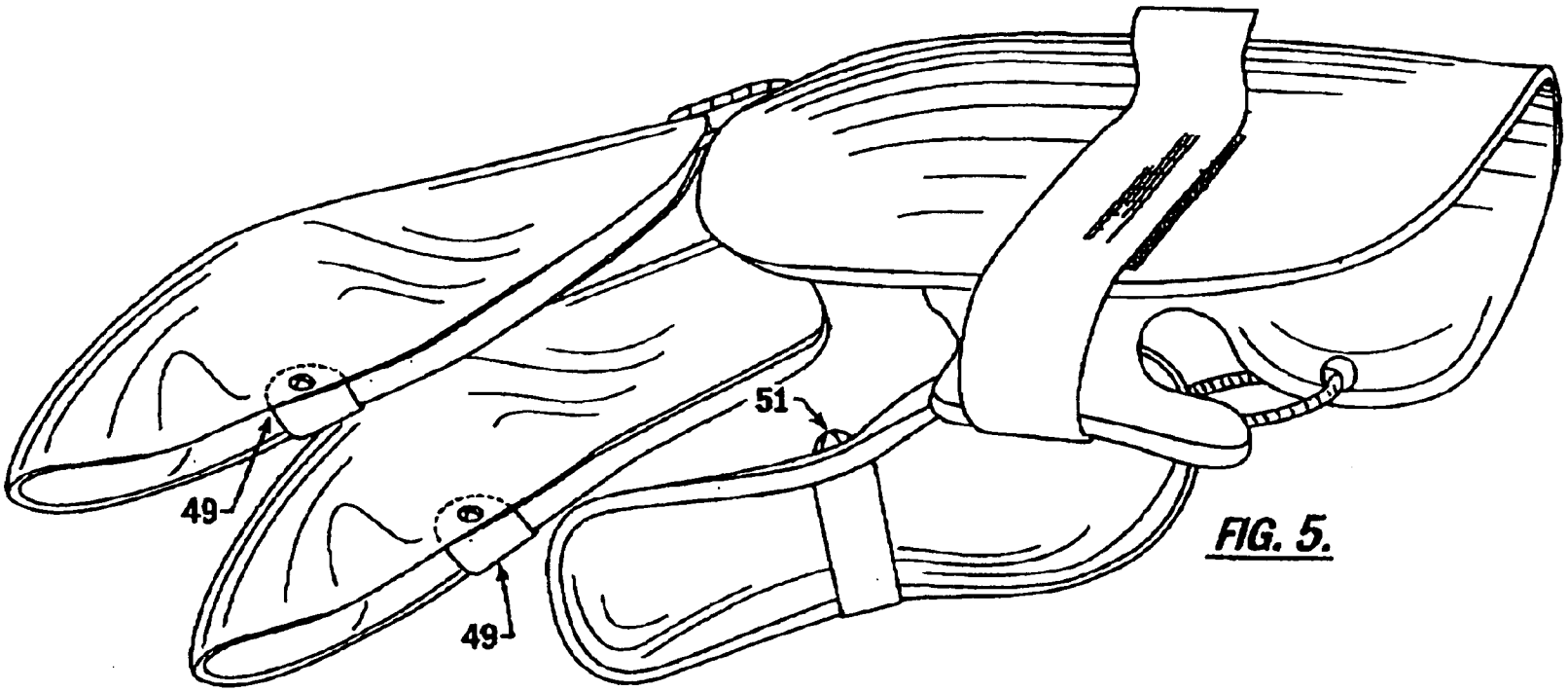
FIG. 5 is a side plan view of a hand guard containing a metacarpal guard and three digit guards connected to the metacarpal guard by bands, with the metacarpal guard containing a fastener of the hook and loop type tapes, and the digit fasteners containing integral push-tab protrusions.

With reference to FIG. 5, the linkages between the metacarpal guard and the digit guards is illustrated by way of loops, the digit fasteners are integral push tab strips 49, with terminal tapered push tabs 51 fastened at the borethrough holes on the opposite sides of the digit guards.

Figure 6:
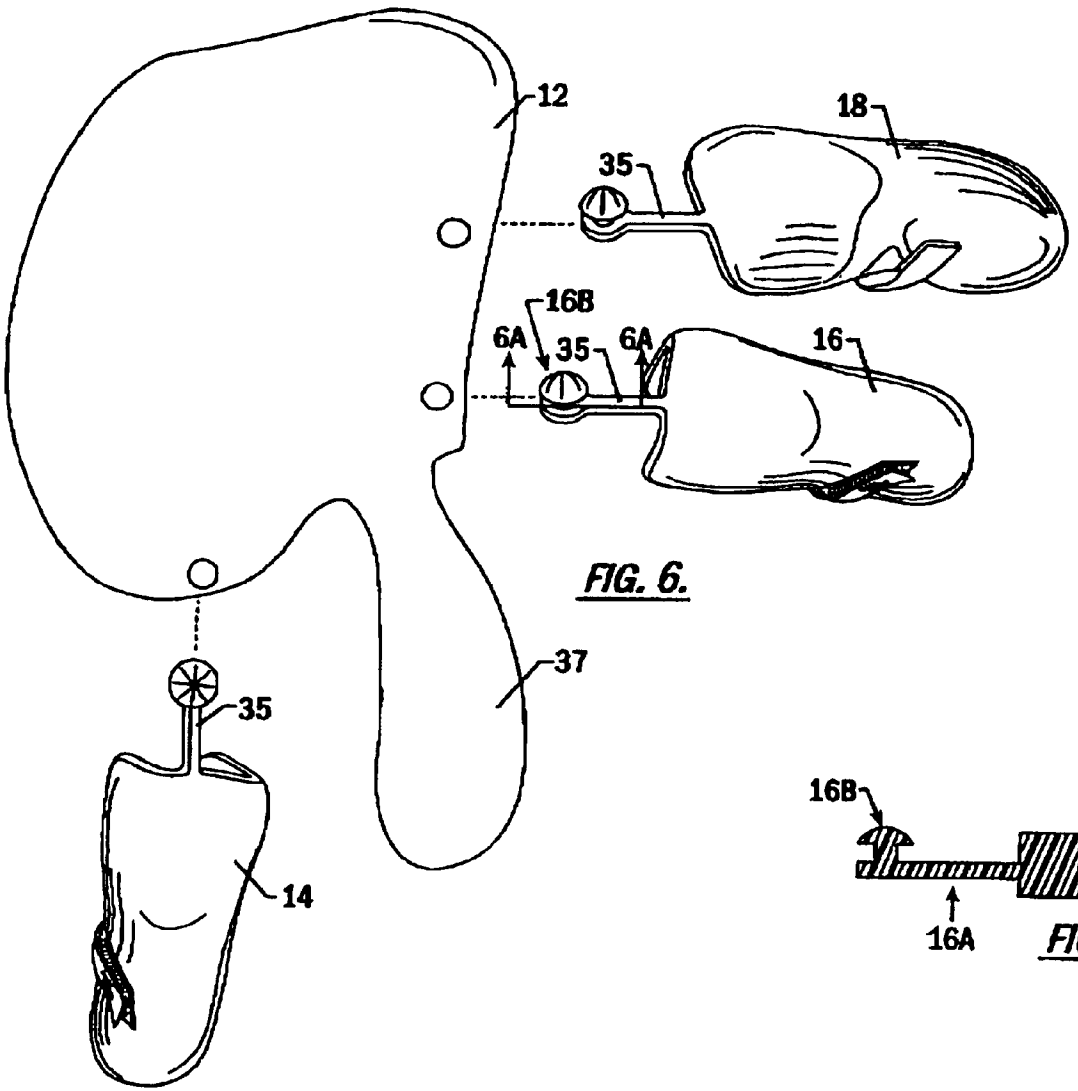
FIG. 6 is a top exploded view of a hand guard illustrating borethrough holes on the metacarpal guard for receiving the integral push-tabs of the digit guards, prior to shaping.
Figure 6A:
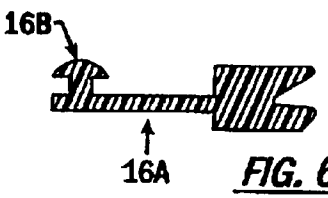

FIG. 6 illustrates a top plan view of a digit guard for a left sensing hand, with digit guards 14, 16 and 18, each comprising integral digit guard linking tabs 35 with terminal push-tabs 16B. The digit guards are merely arranged along with the metacarpal guard 12 to approximate a multi-piece die-stamped film. In a detailed section view of a portion of the index finger guard 16 at the linking point, the thickness in the linking strand portion is advantageously less than the wall thickness of the film in the covering area, to allow greater flexibility in each of the digit guards.

Figure 7:
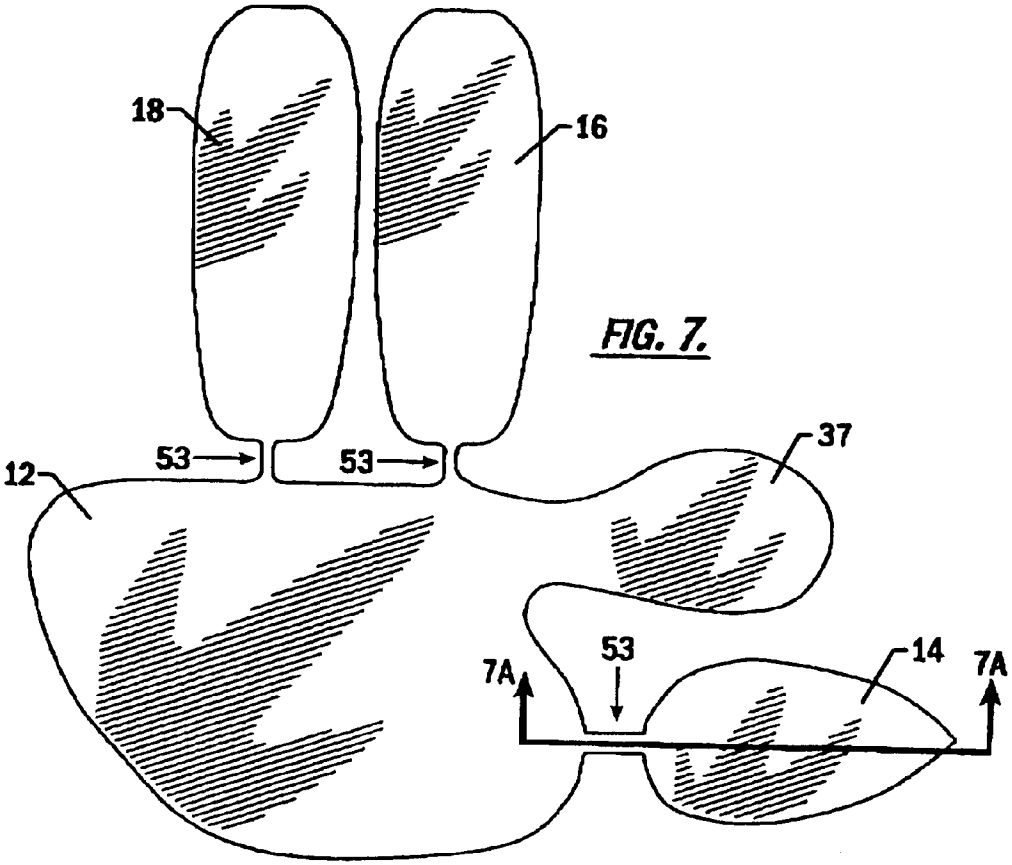
FIG. 7 is a perspective view of a one-piece hand guard construction, illustrating the died-out pattern of the guard, prior to shaping.
Figure 7A:
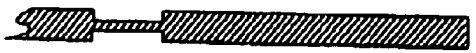

FIG. 7 illustrates a one-piece die cut construction, prior to shaping as discussed herein. In detailed cross-sectional view of the thumb area, the film thickness of the integral linking strands 53 are less than the thickness of the thumb guard as shown in FIG. 7A. Not shown is the metacarpal fastener system, which could be an additional integral linking strand, such as protruding from the protrusion wrapping member 37.

Figure 8:
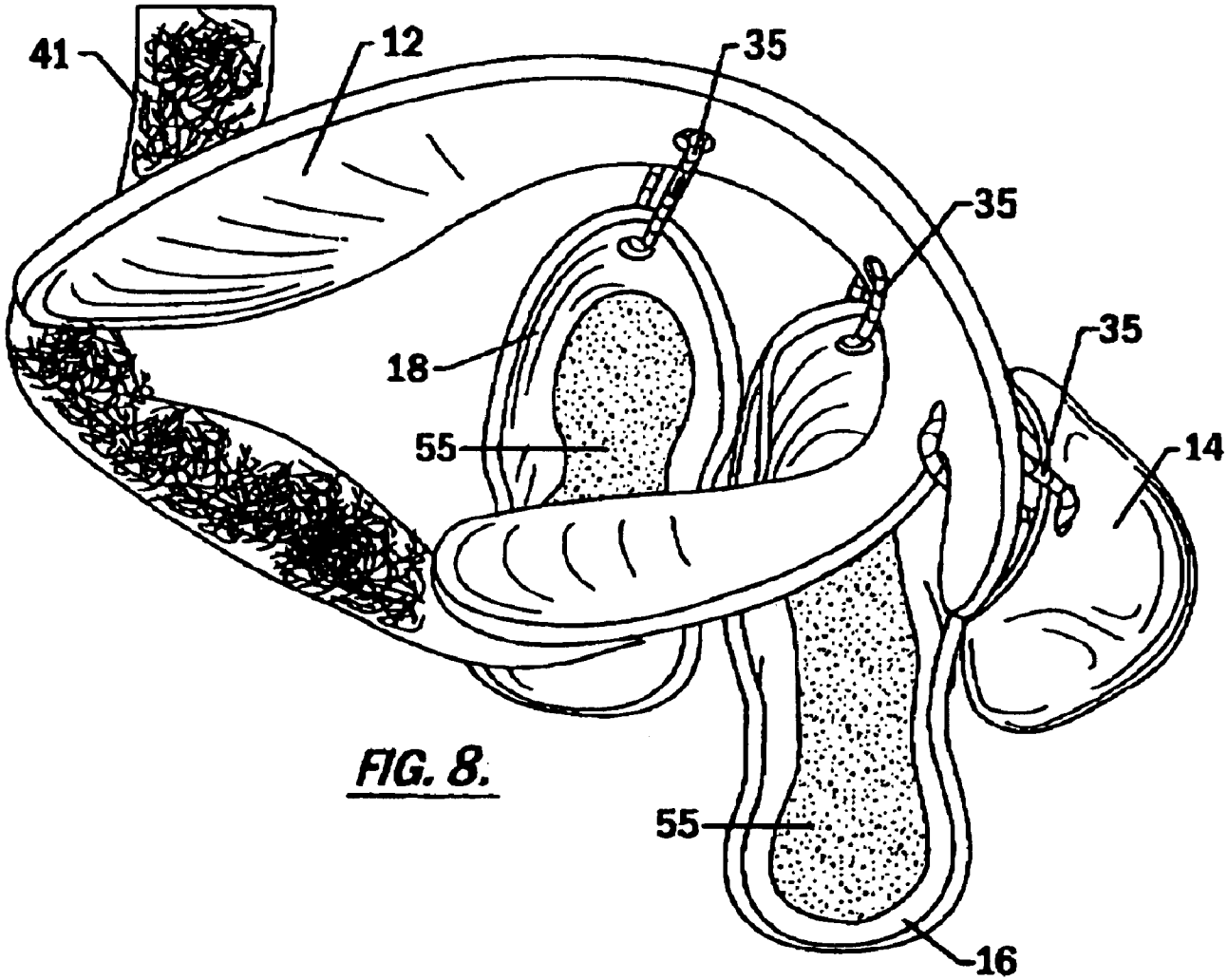
FIG. 8 is a rear view of a hand guard illustrating the hook and loop-fastened metacarpal guard and digit guards containing digit fasteners which are adhesives applied to the digit contacting side, or ventral side, for pressing directly on the skin on the dorsal side of each digit.

With reference to FIG. 8 the rear view of a hand guard illustrates an engaged hook and loop-fastening 41 of the metacarpal guard 12. The digits guards are attached by loops 35. The ventral side of digit guards (shown for guards 16 and 18) contain affixed tacky or pressure sensitive films 55. Adhesive films 55 are preferably covered with a release film or tape during packaging (not shown). The release film will be peeled off by the wearer to reveal the tacky adhesives at the time of donning the guard. The digit guards are pressed against the wearers skin on the dorsal side of the digits. The adhesive is conventionally formulated, for example, with skin-tolerant materials used in conventional adhesive bandages or tapes to provide sufficient adhesive strength to the skin so that the guards do not separate over the flexing range of the fingers, but can be peeled from the skin when doffing the guard after use.

Materials of Construction

A variety of known materials can be employed in the construction of the hand guards. The guards have thickness generally of from 5 to 50 mils, and preferably from 10 to about 25 mils. With reference to the physical properties of a foil, such as flexural modulus, or flex resistance, unless otherwise stated, these properties are described at ambient temperatures, e.g. room temperature, 23 degrees Centigrade. Each of the components of the hand guard can be formed of the same or different materials, depending upon design preferences. The suitability of material selected will depend upon the desired thickness, flexing and puncture resistance sought. Materials can be selected from a range of room-temperature flexural modulus. For example the metacarpal guard, thumb guard, index finger guard, and second finger guard can be formed from the same or different material, selected from elastomers, flexible-, semiflexible-, semi-rigid- or rigid material. Thermoplastics in each of these categories are readily selected.

In one embodiment, the metacarpal guard component can be selected of a lesser flexible (higher flex modulus) material than the digit guards. Linking strips, straps, bands and the like preferably will have a thinner gauge than the guard components. Preferably the same polymeric material is utilized for all of the guard components.

A rigid material is defined generally as a material having a flexural modulus of a magnitude that in the form of a 5–50 mil film shaped according to the description herein, exhibits minimal (less than 5 degrees of bending) or no bending upon bending or flexing of the hands and/or fingers. A thin foil of 5 to about 15 mils thickness of a rigid thermoplastic material can be adapted for the guard components herein described.

A semi-rigid thermoplastic material is defined generally as a material that in the form of a 5–50 mil film shaped according to the description herein exhibits a resistive flexing proportional to the bending or flexing exerted by the hand, but does not completely yield under maximal flexing or bending of the hand and/or fingers. The yield upon bending or flexing is greater than 5 degrees and the finger or palm will flex beyond the yield point of a semi-rigid material. The resistive-yield is noticeable by the wearer upon light flexing or bending, and would impede the entire range of flexing or bending of the fingers and/or palm. A foil generally of 5 to about 25 mils made from a semi-rigid thermoplastic material is adaptable for the guard components herein described. Linking straps, strips, and the like can also be made of these materials, and generally will have relatively thinner gauge thickness relative to the guard components.

A semiflexible thermoplastic material exhibits as a 5—5 mil film covering the defined portion of the hand, as described herein, exhibits a lesser degree of resistive yield than a semi-rigid materials and a lesser degree of impedance of the maximum range of hand or finger flexure, and is capable of up to about 5% elongation in response to flexure by the hand and/or fingers, but is perceived by the wearer as impeding delicate flexing of the hands and/or fingers. A foil generally of 5 to about 25 mils made from a semi-flexible thermoplastic material is adaptable for the guard components herein described, as well as the linking strips, loops, straps and the like.

A flexible thermoplastic material is generally defined as a material that in the form of a 5–50 mil film covering the defined portion of the hand, as described herein, will exhibit a slight noticeable resistive yield on minimal flexing of the hand and/or fingers. A flexible material will yield upon delicate flexing of the hands and/or fingers and may exhibit up to 20% elongation. A foil generally of 5 to about 50 mils made from a semi-flexible thermoplastic material is adaptable for the guard components herein described, as well as the linking strips, loops, straps and the like.

An elastomeric material can be formulated to provide a wide range of flexural modulus, and elongation depending upon the degree of crosslinking and proportion of rubbery phase component, generally. A cured, unreinforced rubber, such as natural rubber, SBR rubber, butyl rubber, or flexible polyurethane generally will exhibit a glass transition temperature below 0 degrees Centigrade and provide a low flexural resistance similar to a flexible material. As another example, a rigid thermoplastic, metallic material, e.g., aluminum, a coated fabric, or fiber reinforced woven or nonwoven molded composite can be used. A cast, thermosetting material can also be used for the digit guards, but these are not preferred materials.

Medical-grade polymers suitable for skin contact are readily available. Transfer adhesives and tapes and adhesive coated film tapes that are suitable for direct application on skin, such as hydrocolloid adhesives that resists breakdown from skin moisture and adhere to skin well are available from, for example, 3M.

The preferred hand guard embodiments are readily formed from a variety of elastomeric, flexible thermoplastic, semi-rigid and rigid thermoplastic and thermoplastic elastomer materials, either formed in a single layer, or multiple layer co-extrudate films or laminates. Exemplary preferred materials are based on melt-processible thermoplastics and thermoplastic elastomers. Thermoplastics include polyethylene, polypropylene, and copolymers of such polyolefins. Polyolefin homo- and copolymers having less than 75% crystallinity are preferred polyolefins.

Alloys of amorphous and crystalline thermoplastic polymers are well known and also preferred. Flexibilizing polymers or plasticizers useful for compounding of commodity thermoplastics are readily suitable, and are well known in the medical plastics industry, e.g. phthalate-, sebacate-, fumarate-, and glutarate-plasticized PVC. Well-known medically approved skin contact materials are available widely. Reference is made to recent editions of Modern Plastics Encyclopedia, herein incorporated by reference.

Vinyl polymers, polyester, polyamide, plasticized PVC, PVC copolymers, and the like, are among the many materials that are adaptable herein as well as easily sterilized. Thermoplastic elastomers, such as available under the Santoprene Æ, and Kraton Æ trademarks are also well known and suitable. Other melt-processible materials include TPO, TPE, EPDM, SBS, PS, ABS, ASA, SEBS, and CPE. The guards may be formed from elastomers such as the aforementioned natural rubber, and synthetic elastomers, as well as such materials as polychloroprene, ethylene-propylene rubber, silicone rubber, and elastomeric or thermoplastic, and plastisol-coated fabrics, and the like.

Method of Making

In the construction of the preferred hand guard using melt-processible materials, an exemplary conventional method is injection molding. Injection molding of the individual guards is readily practiced by forming a multi-cavity mold halves that define cavities representing the contours, thicknesses, and shapes of the guard components, including integral fastener protrusions if so designed. The guard shapes and contours generally conform as overlayed on the surface of the covered portion of the hand features described herein. The above-mentioned fasteners can be affixed to the guards in cases where fasteners of a type that must be affixed are employed, i.e. not integral. As an advantage of the injection molding method, push-tab fastener straps can be separately or integrally injection molded in the same cavity since the cross-sectional area of the tab-inserts is not significantly larger than the thickest cross-section of the guard covering portions. Integral fastening tabs can be provided for each guard component in the mold design as an alternative, as such integral fastening tabs are shown in FIG. 7.

In an alternative embodiment, the hand guard is die-stamped from a single or unilayer film (one-piece), or from a multilayered film as depicted in FIG. 7, which is extruded, co-extruded, calendared, or cast into a foil (film), generally of predetermined thickness ranging generally anywhere from about 5 to about 75 mils thick, and predetermined from design and selection of the material of construction. As a further adaptation, there may be a "few-piece" design, such as one piece incorporating the metacarpal and thumb guard, and two other pieces for finger guards. This one- or few piece design is well adapted for employing digit retaining fasteners of the adhesive tape, hook and loop, and slot tab protrusion-type fasteners.

A one-piece film can be shaped, and die-cut in the outline of an integral pattern as shown in FIG. 7. The die cut film is then placed in a compression mold to form the shape, contours and thickness variations, such as in the digit linking areas, or at the joints of the fingers, where a thinner gauge may be desired for reduced flex resistance. For mass production of a unitary hand guard from a film (foil), a continuous polymer film of from about 5 to about 50 mils in thickness is unwound from a spool and advanced over a heated compression mold platen, the press is closed, pressure is applied, and the embossing/shaping/contouring, and otherwise patterned film is cooled, then advanced over a cutting die and died out. Rough died impressions may be dislodged and stacked, or a the film kept intact and pulled by puller rolls or belting and cut at a point beyond the puller for generating scrap or material to be chopped and recycled into the process. When using a take-up spool or puller, the film is advanced and position in a cycle and registered through the compression molding and die-cutting steps.

In yet another method for making the hand guard of a continuous film is by way of thermoforming, which is similar in principle to compression molding, without added pressure of a clamping press. A heated, and softened polymer film is advanced from a heating zone over or under a perforated female or male mandrel which is connected to a vacuum source. The film edges come into contact with the periphery of the mandrel by lowering or raising the film, and gas is withdrawn, causing the film to draw down over, or into the mandrel. After sufficient cooling of the film the shape sets, and the shaped film is withdrawn, and further trimmed or die-cut.

Method of Using

Donning the hand guard is easiest by first wrapping the metacarpal guard around the hand and fastening the straps using the free hand, or adhering the tape, or otherwise in accordance with the fastening systems employed. By using the free hand to wrap the thumb with the thumb fastener, after placing the thumb under the thumb guard this step is repeated for the one or more finger guards. The hand guard may be conveniently packaged in a sterilized hermetically sealed wrapper. In some cases, it may be desirable to gamma sterilize the hand protector package. Latex examination gloves may be placed over or under the hand guard for further germ protection. To reduce the need to repeatedly sterilize the hand protector of the present invention, rubber gloves may advantageously be put on after the hand protector is placed on the sensing hand. In that way, the rubber gloves will protect both the sensing hand and hand protector from germs. After the hand protector is positioned around the metacarpal region, thumb and one or more fingers of the sensing hand, the fastening straps are fastened about the interphalange joint of the thumb and middle phalanx of the finger(s).

What is claimed is:

1. A unitary, one-piece hand guard for protect a sensing hand from sharp implements a unitary set of guards fabricated from one foil, and comprising palm/metacarpal guard portion integrally linked to three digits guard portions, said metacarpal guard portion shaped to cover the metacarpals and wrap around over part of the palm and thenar web space areas, and fastenable to itself by a fastener, each of said digit guard portions containing a digit fastener that yields or is disengaged for removing the guard after use, the digit guards are the thumb and two finger guards, each shaped as an elongated, hemispherical, cupped foil with contours to fit in overlying position and covering the dorsal and lateral portions of the digits extending, respectively over a portion of both phalanges of the thumb, and two or three phalanges of the fingers.

2. The hand guard of claim 1 wherein said digit fasteners are integral at one end at the sides of the digit guards and protrude to a free terminal end having a fastener, which can engage the opposite side into a slot, a borethrough hole or adhesive-receptive surface.

3. The hand guard of claim 2 wherein the free terminal end contains a fastener selected from the group consisting of adhesive, hook or loop pad, slot insert tab, push tab insert and a snap.

4. A hand guard assembly in three separate pieces, comprising an integral metacarpal guard with hook and loop fastener, and integral thumb guard, and two detached finger guards, said finger guards containing adhesive affixed to the undersides, and said thumb guard containing a hook and loop fastener.

5. A hand guard in three separate pieces wherein a metacarpal guard is integrally linked to an index finger guard, and including a separate thumb guard, said finger or thumb guard containing hook and loop fasteners, or direct skin-adhering adhesive affixed to the underside surface of each digit guard, said adhesive covered by a release film for storage prior to use.

* * * * *